United States Patent [19]

Tadokoro

[11] 4,117,674

[45] Oct. 3, 1978

[54] ENGINE AND REACTOR CONNECTION SYSTEM

[75] Inventor: Tomoo Tadokoro, Hiroshima, Japan

[73] Assignee: Toyo Kogyo Co., Ltd., Japan

[21] Appl. No.: 721,546

[22] Filed: Sep. 8, 1976

[30] Foreign Application Priority Data

Sep. 25, 1975 [JP] Japan ..... 50-131672[U]

[51] Int. Cl.[2] ..... F01N 3/10

[52] U.S. Cl. ..... 60/282; 60/322; 285/368

[58] Field of Search ..... 60/282, 303, 322; 285/363–368

[56] References Cited

U.S. PATENT DOCUMENTS

| | | | |
|---|---|---|---|
| 1,567,813 | 12/1925 | Oleson | 285/363 |
| 2,157,357 | 5/1939 | Straty | 285/363 |
| 3,302,953 | 2/1967 | Glasgow | 285/363 |
| 3,958,418 | 5/1976 | Heidacker et al. | 60/282 |
| 3,965,881 | 6/1976 | Sakurai et al. | 60/282 |
| 3,984,977 | 10/1976 | Morita et al. | 60/282 |
| 4,013,098 | 3/1977 | Tadokoro et al. | 60/303 |

*Primary Examiner*—Robert E. Garrett

[57] ABSTRACT

A connection system for a connection between an exhaust port of an internal combustion engine and an intake port of a thermal reactor for substantially purifying exhaust gases emitted from the engine. An engine casing has an exhaust passage accommodating therein a tubular insert while the thermal reactor has an intake pipe leading into a reaction chamber. The tubular insert has a radially outwardly extending flange on one end and the intake pipe has a radially outwardly extending flange on one end. When the thermal reactor is operatively coupled to the engine, the flange on the tubular insert and the flange on the intake pipe are coupled to each other with a heat transmitting connecting member therebetween. An annular portion of the flange on the intake pipe is, when the reactor is thus coupled to the engine, allowed to elastically deform to generate a force with which the intake pipe and the tubular insert are relatively fixedly restrained in position. The flange on the intake pipe also has an area of reduced surface contact.

32 Claims, 11 Drawing Figures

ENGINE AND REACTOR CONNECTION SYSTEM

BACKGROUND OF THE INVENTION

The present invention generally relates to a piping system and, more particularly, to an improvement in a piping connection between an exhaust port of an internal combustion engine and an intake port of a thermal reactor for substantially purifying exhaust gases emitted from the combustion engine.

In some conventional combustion engines used, for example, on automotive vehicles, an exhaust gas purifying device, such as a thermal reactor for reburning noxious, residual combustibles present in the exhaust gases to substantially purify the latter, is installed in the exhaust system of the engine. Because of the nature and construction of the thermal reactor which is well known to those skilled in the art, reduction of the temperature of the exhaust gases prior to said exhaust gases entering the thermal reactor does not ensure an efficient and effective re-combustion of the residual combustibles in the exhaust gases within the thermal reactor.

In order to avoid the undesirable reduction of the temperature of the exhaust gases introduced into the thermal reactor, various methods have heretofore been employed. One of these methods is the use of a tubular insert installed within an exhaust passage leading from the combustion chamber to the exhaust port, such as disclosed in U.S. patent application Ser. No. 607,822, filed on Aug. 25, 1975 now U.S. Pat. No. 3,984,977 and assigned to the same assignee of the present invention.

According to U.S. patent application Ser. No. 607,822, the tubular insert extends from a plane of the opening of the exhaust port into the exhaust passage and is supported in position in spaced relation to the wall of the engine block or casing which surrounds the exhaust passage by means of a heat insulating member of a substantially ring shape. By the interposition of the heat insulating member or ring, dissipation of the heat evolved in the tubular insert in contact with the exhaust gases flowing therethrough, which may take place due to contact with the generally forcibly cooled engine block, is advantageously minimized. Moreover, that end of the tubular insert flush with the opening of the exhaust port is radially outwardly flanged and is in turn restrained by one or more set pins extending through a portion of the engine block into the flanged end of the tubular insert in a direction perpendicular to the longitudinal axis of the tubular insert, for avoiding relative rotation of the tubular insert and also for avoiding possible separation of the tubular insert from the exhaust passage.

Another method is the provision of a plurality of areas of reduced surface contact in the radially outwardly extending flange rigid or integral with one end of an intake pipe leading into a reaction chamber of the thermal reactor, such as disclosed in U.S. patent application Ser. No. 579,076, filed on May 19, 1975 now U.S. Pat. No. 4,013,098 and assigned to the same assignee of the present invention. The reduced surface contact areas in the flange at one end of the intake pipe are, according to U.S. patent application Ser. No. 579,076, constituted either by arcuate slots arranged in a circular configuration in equally spaced relation to each other or by radially outwardly extending segments defined in the flange by cutting the latter inwards towards the intake pipe at spaced intervals around the circumference of the flange. These reduced surface contact areas, that is, any of the arcuate slots and the cut-out portions each defined between adjacent radially outwardly extending segments in the flange, serve to minimize the undesirable transmission of heat from the intake pipe to the engine block or an outer shell or casing of the thermal reactor by way of the flange at the end of the intake pipe.

The aforesaid methods to avoid the undesirable reduction of the temperature of the exhaust gases to be introduced into the thermal reactor are individually directed to the exhaust port arrangement in the combustion engine and to the intake pipe construction in the thermal reactor, respectively. However, even if a thermal reactor having a intake pipe constructed according to the second mentioned U.S. patent application is provided on an engine having the exhaust port constructed according to the first mentioned U.S. patent application, there is still a drawback in that a difference in temperature tends to be created between the tubular insert within the exhaust passage and the intake pipe within the thermal reactor because of the presence of a clearance between the flanged end of the intake pipe in the thermal reactor and the flanged end of the tubular insert within the exhaust passage in the engine block.

On the other hand, U.S. Pat. No. 3,635,031, patented on Jan. 18, 1972, discloses the use of a single piping element connecting either one of the exhaust port in the engine block and the intake port in the thermal reactor to the other of the exhaust port and the intake port and having one end situated within the exhaust passage in the engine block and the other end situated within the thermal reactor and connected to an opening in an inner shell defining the reaction chamber. The employment of the single piping element is advantageous in that the temperature at the end of the piping element adjacent the reaction chamber can readily be transmitted to the opposite end of the piping element adjacent the combustion chamber of the combustion engine, thereby causing the piping element to be kept heated by the elevated temperature prevailing within the reaction chamber of the thermal reactor.

Although the single piping element functions satisfactorily, mounting of the thermal reactor on the combustion engine is complicated and time-consuming.

SUMMARY OF THE INVENTION

Accordingly, the present invention has for its object to provide an improved piping connection between a exhaust port of the internal combustion engine and the intake port of a thermal reactor for connecting either one of the tubular insert within the exhaust passage and the intake pipe within the reactor to the other of the tubular insert and the intake pipe in thermally conductive relation to each other and also for supporting the adjacent flanged ends of the tubular insert and intake pipe in a manner fixed relative to the engine block and the thermal reactor.

According to the present invention, the combustion engine block having at least one combustion chamber formed therein has a flat, planar surface portion in which the exhaust port is defined. The exhaust port is in communication with the combustion chamber through an exhaust passage which is enlarged in diameter in at least one stage to provide a land at one end portion thereof adjacent the exhaust port. The land thus defined substantially separates the exhaust passage into a large diameter bore and a reduced diameter bore which are respectively situated adjacent the exhaust port and the combustion chamber.

The tubular insert has integral with one end portion a radially outwardly extending flange having an outer diameter smaller than the diameter of the large diameter bore and a thickness smaller than the depth of the large diameter bore, which depth is measured in terms of the distance between the plane of the exhaust port and an annular face of the land facing the exhaust port. The other end portion of the tubular insert opposed to the flange has an outer diameter smaller than the diameter of the reduced diameter bore. The flange on the tubular insert has an annular seat in one of the outer peripheral edges adjacent the annular face of the land, which annular seat is formed by cutting the one of the outer peripheral edges of the flange inward towards the longitudinal axis of the tubular insert. After this tubular insert is inserted within the exhaust passage with the large diameter bore and the reduced diameter bore respectively accommodating the flange and the other end portion of the insert, a heat insulating ring is mounted on the annular seat in the flange on the tubular insert and sandwiched between the annular face of the land and the annular seat. The heat insulating ring serves not only to minimize the heat transmission from the tubular insert to the engine block which is generally forcibly cooled, but also to support the tubular insert within the exhaust passage in spaced relation to the wall defining and, therefore, surrounding the exhaust passage.

The arrangement thus far described is substantially disclosed in the U.S. patent application Ser. No. 607,822 referred to above, except that no mounting pins are employed in the present invention for restraining the tubular insert non-rotatably and axially non-movably within the exhaust passage.

On the other hand, the thermal reactor comprises an outer casing having a mounting flange through which the thermal reactor is fitted to the engine block by means of a plurality of bolts or set screws. The mounting flange has a flat, planar surface which is, when fitted to the engine block, held in contact with the flat, planar surface portion of the engine block and on which an intake port is defined in communication with a reaction chamber defined by an inner casing or shell of the thermal reactor.

A tubular intake pipe having on one end a radially outwardly extending flange extends from the intake port into the reaction chamber with the outer annular face of the flange on the intake pipe held flush with the flat, planar surface of the reactor outer casing. As disclosed in the U.S. patent application Ser. No. 579,076 referred to above, the flange on the intake pipe has an area of reduced surface contact arranged in a circular configuration and positioned substantially intermediately of any one of the opposed annular faces of the flange on the intake pipe.

In accordance with the teachings of the present invention, a connecting member is utilized which, when the thermal reactor is connected to the combustion engine with the mounting flange bolted to the engine block while the exhaust port and the intake port are aligned with each other, is positioned between the outer annular face of the flange on the tubular insert opposed to the annular seat and the outer annular face of the flange on the intake pipe. At this time, because of the interposition of the connecting member, the outer peripheral portion of the flange on the intake pipe, which is forced to contact the flat, planar surface portion of the engine block because it is sandwiched between the mounting flange of the reactor and the engine block, is elastically deformed relative to an inner peripheral portion of the flange on the intake pipe adjacent the latter, with said inner peripheral portion of the flange on the intake pipe thereby applying an axial pushing force to the tubular insert through the connecting member. By this axial pushing force generated in the flanged end of the intake pipe due to the elastic deformation as described above, the tubular insert is retained in position with the entire outer peripheral surface thereof substantially equally spaced from the wall surrounding the exhaust passage.

The connecting member may be constituted by a ring element of metallic material which may be either welded to or integrally formed with either the tubular insert or the intake pipe. Alternatively, the connecting member may be constituted by a plurality of arcuate elements of metallic material which may be either welded to or integrally formed with either the tubular insert or the intake pipe. Where the connecting member is separate from and, therefore, must be welded to either the tubular insert or the intake pipe, the connecting member is preferably prepared from a metallic material having a relatively high thermal conductivity, such as cast iron. In any event, the connecting member employed in the present invention serves not only to facilitate heat transmission from the intake pipe towards the tubular insert, but also to bias the flanged end of the tubular insert in a direction opposite to the intake pipe in cooperation with the resilient force which is developed in the flange when deformation of the intake pipe takes place in the manner as hereinbefore described.

The reduced surface area of the flange on the intake pipe may be of any known construction and, however, is to be understood, in the present invention, as serving not only to minimize the heat transmission from the intake pipe towards the reactor outer casing and/or the engine block, but also to impart to the flange on the intake pipe a latent resiliency which, when the flange on the intake pipe is subsequently deformed in the manner as hereinbefore described, is used to generate the resilient force necessary to bias or urge the tubular insert through the connecting member in the direction opposed to the intake pipe.

BRIEF DESCRIPTION OF THE DRAWING

For a more complete understanding of the present invention, the latter will now be described in conjunction with preferred embodiments thereof with reference to the accompanying drawings, in which.

DETAILED DESCRIPTION OF THE INVENTION

Figure 1:
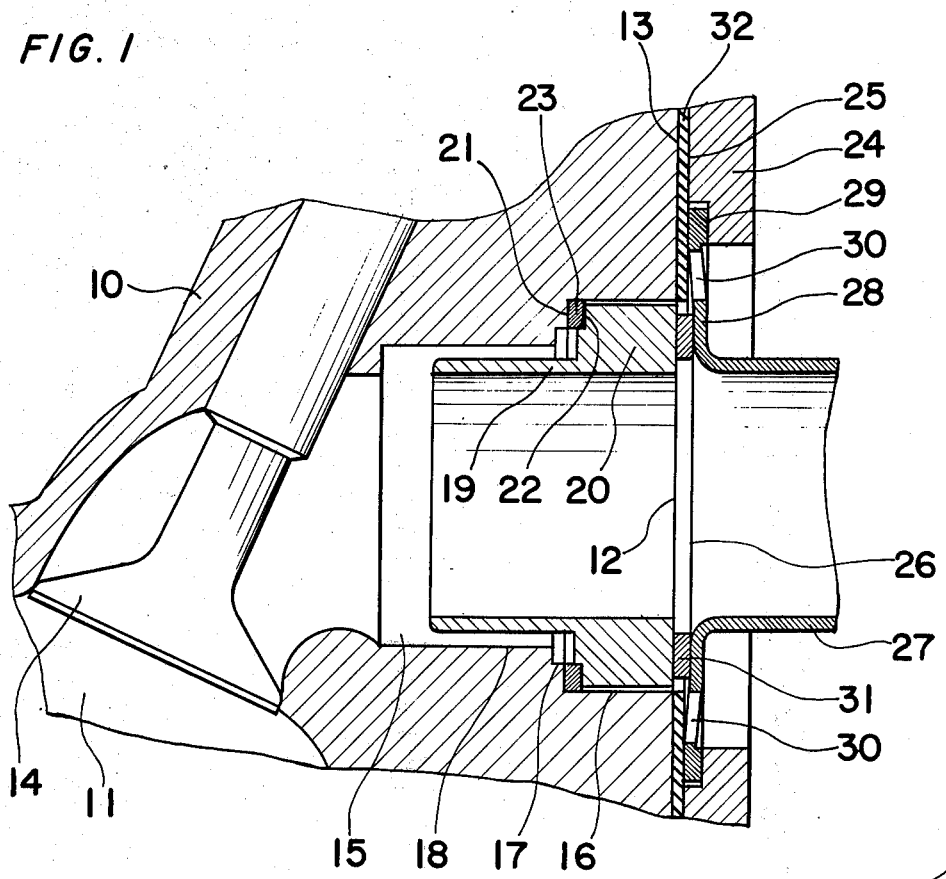
FIG. 1 is a sectional view of a portion of a combustion engine shown together with a thermal reactor flanged to the engine block according to one preferred embodiment of the present invention, the thermal reactor being partially shown in section.

Before the description of the present invention proceeds, it is to be noted that like parts are designated by like reference numerals throughout the accompanying drawings.

Figure 2:
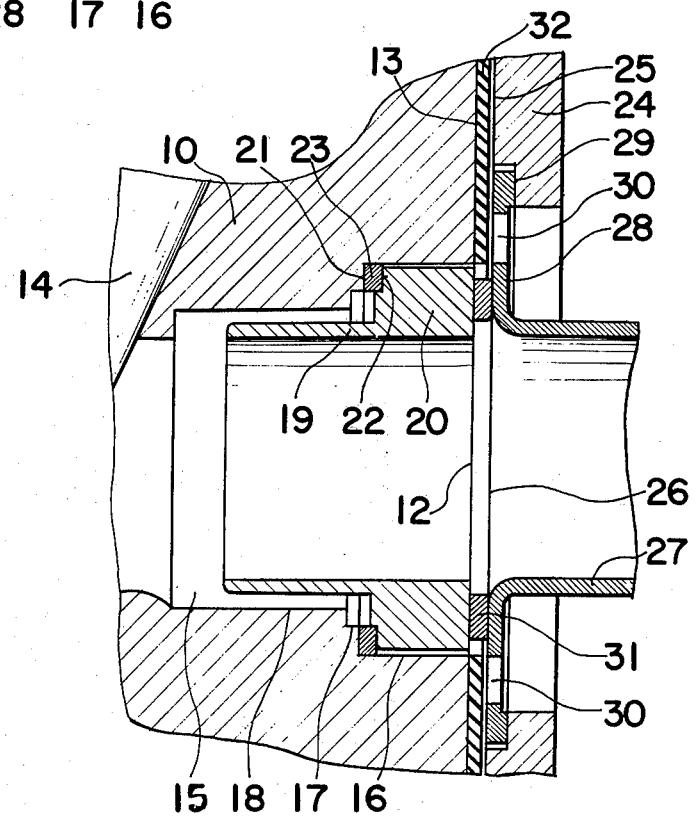
FIG. 2 is a view similar to FIG. 1, showing the thermal reactor prior to being tightly connected to the engine block.

Referring first to FIGS. 1 and 2, there is partially illustrated a combustion engine casing 10 having at least one combustion chamber 11 and an exhaust port 12 defined on a flat, planar surface portion 13 of the engine casing 10. As is well known to those skilled in the art, combustion of an air-fuel mixture taking place within the combustion chamber 11 creates exhaust gases which are periodically vented, by the opening of an exhaust valve, shown in the form of a poppet valve 14, towards the exhaust port 12 through an exhaust passage 15 extending between the combustion chamber and the exhaust port 12, the latter being constituted by the opening at one end of the exhaust passage 15.

The exhaust passage 15 has an outer end portion adjacent the exhaust port 12 shown to be radially outwardly increased in diameter in two stages to provide first, second and third bores 16, 17 and 18, the diameter of each of which is greater than that of the remaining portion of the exhaust passage 15 and stepwisely decreases in the order from the first bore 16 to the third bore 18. This exhaust passage 15 accommodates therein a tubular insert 19 which will now be described.

The tubular insert 19 has at one end adjacent the exhaust port 12 an integrally formed radially outwardly extending flange 20 having an outer diameter smaller than the diameter of the first bore 16 and a thickness smaller than the depth of the first bore 16, it being understood that the depth of the first bore 16 is measured in terms of the axial length or distance from the plane of the exhaust port 12 to the annular face 21 of a land defined between the first and second bores 16 and 17 in the wall of the engine casing which surrounds the exhaust passage 15. The flange 20 has an annular seat 22 defined in one of the outer peripheral edges thereof adjacent the annular face 21 of the land and remote from the exhaust port 12, which annular seat is formed by cutting the one outer peripheral edge of the flange 20 inward towards the longitudinal axis of the tubular insert 19.

This tubular insert 19 is held in position within the exhaust passage with the outer peripheral edge of the flange 20 engaged with the land between the first and second bores 16 and 17 through a heat insulating ring member 23 which is mounted on the annular seat 22, one of the annular faces of the flange 20 opposite to the annular seat 22 being positioned flush with the flat, planar surface portion 13 of the engine casing 10.

The tubular insert 19 within the exhaust passage 15 is substantially fixedly retained in the described position when the thermal reactor is connected to the combustion engine in a manner which will subsequently be described.

As is well known to those skilled in the art, the thermal reactor, although not shown, is substantially double-walled and, therefore, has outer and inner casings, the inner casing defining therein a reaction chamber while the outer casing has a mounting flange through which the thermal reactor is connected to the combustion engine block, a portion 24 of which mounting flange is shown in FIGS. 1 and 2, it being understood that the mounting flange 24 has a flat, planar surface 25 in which an intake port 26 is defined and which, when the thermal reactor is secured to the engine casing 10, rests flat against the flat, planar surface portion 13 of the engine casing 10.

The thermal reactor includes an intake pipe 27 having one end opening into the reaction chamber (not shown) and the other end opening at the intake port 26 and having an integrally radially outwardly extending flange 28. This intake pipe 27 extends from the intake port 26 towards the reaction chamber with the outer peripheral portion of the flange 28 engaged in a circular recess 29 formed in the flat, planar surface 25 of the mounting flange 24. It is to be noted that, as best shown in FIG. 2, prior to the mounting of the thermal reactor on the engine casing with the intake port 26 aligned with the exhaust port 12, an outer annular face of the flange 28 opposed to the reaction chamber is flush with the plane of the flat, planar surface 25 of the mounting flange 24.

Figure 3:
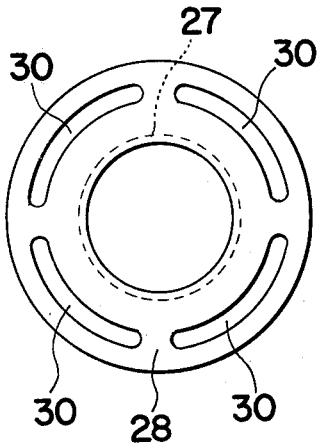
FIG. 3 is an end view of an intake pipe used in the thermal reactor shown in FIG. 1.

In order to impart to the flange 28 a resiliency by which the flange 28, when deformed in a direction parallel to the longitudinal axis of the intake pipe 27 and outwardly of the latter, seeks to assume its original shape or position, the flange 28 has an area of reduced surface contact which is, in the embodiment shown in FIGS. 1 and 2, constituted by a plurality of, for example, four, equally spaced arcuate slots arranged in a circular configuration, which arcuate slots are best shown in FIG. 3 and generally indicated by 30. It is to be noted that the reduced surface contact area of the flange 28, which has been described as constituted by the arcuate slots 30 in the embodiment of FIGS. 1 and 2, serves an additional function of minimizing the heat transmission from the intake pipe 27 towards the mounting flange 24 and/or the engine casing 10.

When and after the thermal reactor is secured to the engine casing 10 as shown in FIG. 1, a connecting member, which is shown to be constituted by a metal ring 31 in the embodiment of FIGS. 1 and 2, is positioned between the flanges 20 and 28 while the mounting flange 24 of the thermal reactor is bolted, or otherwise secured, to the engine casing 10 through a gasket 32 tightly held in position between the flat, planar surfaces 13 and 25. Although the gasket 32 may not be essential, the thickness of the metal ring 31 is preferably greater than the thickness of the gasket 32 where the latter is employed as shown.

As can readily be seen from a comparison of FIG. 1 with FIG. 2, at the time of completion of the mounting of the thermal reactor on the engine casing 10, a substantially outer peripheral portion of the flange 28 other than the portion of the same flange 28 which is held in contact with the metal ring 31 is axially outwardly deformed i.e. deformed toward the engine casing 10. With the flange 28 thus deformed, the resiliency developed in the flange 28 produces an axial pushing force which is transmitted from the intake pipe 27 to the tubular insert 19 through the metal ring 31 so that the tubular insert 19 is relatively fixedly restrained in position with the outer peripheral surface substantially equally spaced from the wall surrounding the exhaust passage 15.

Figure 4:
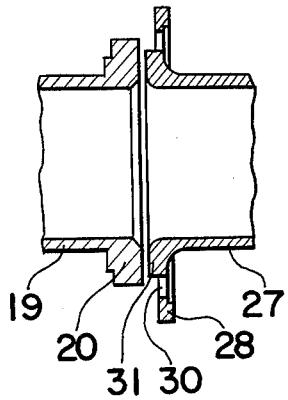
FIGS. 4 to 8 are longitudinal sectional views showing different positions of a connecting member which, when the thermal reactor is flanged to the engine block, is firmly sandwiched between flanged ends of the tubular insert and the intake pipe.
Figure 5:
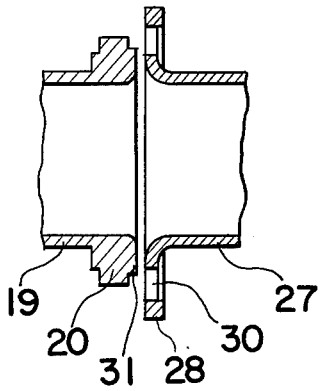
Figure 6:
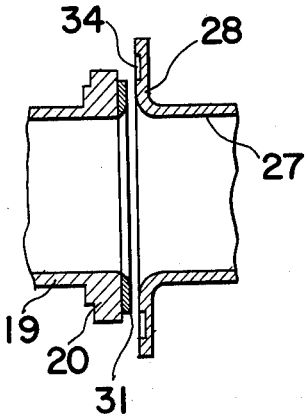

For avoiding any possible displacement in position of the metal ring 31, the metal ring 31 is, in the embodiment of FIGS. 1 and 2, welded to the outer annular face of the flange 28 facing the flange 20. However, the metal ring 31 may be integrally formed with the flange 28 on the intake pipe 27 as shown in FIG. 4 or with the flange 20 on the tubular insert 19 as shown in FIG. 5. Alternatively, the metal ring 31 may, as shown in FIG. 6, be welded to the flange 20 on the tubular insert 19. In any event, the outer diameter of the metal ring 31 is preferably equal to or slightly smaller than the outer diameter of the flange 20 on the tubular insert 19 so that it will not contact the engine casing 10.

Figure 10:
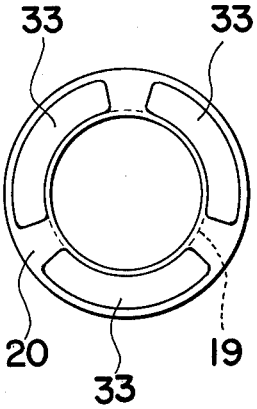
FIG. 10 is an end view of the tubular insert showing a modified version of the connecting member secured to the tubular insert.

While in the foregoing description the connecting member has been described as constituted by the metal ring, it may, however, be constituted by a plurality of metal segments 33 as shown in FIG. 10 and arranged in a circular configuration. In FIG. 10, these metal segments 33 are shown to be welded to the outer annular face of the flange 20 on the tubular insert, but they may be integrally formed with the flange 20. Alternatively, the metal segments 33 may be welded to or integrally formed with the flange 28 on the intake pipe 27.

Figure 7:
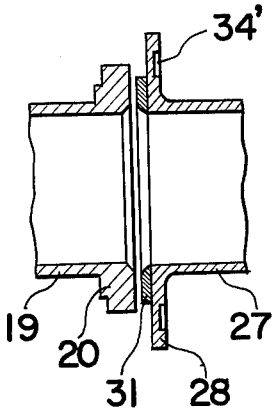
Figure 8:
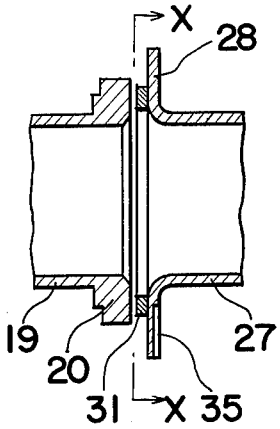
Figure 9:
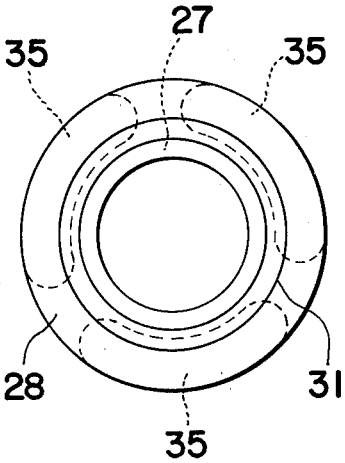
FIG. 9 is an end view taken along the line X—X in FIG. 8.
Figure 11:
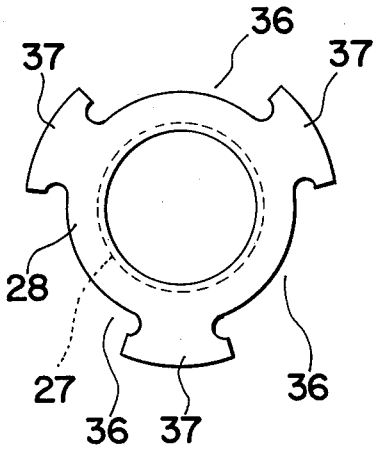
FIG. 11 is an end view of the intake pipe to be used in combination with the arrangement shown in FIG. 10.

Furthermore, while in the foregoing description the reduced surface contact area has been described as constituted by the arcuate slots 30, it may be constituted by an annular recess 34 or 34' shown in FIG. 6 or 7, respectively, a plurality of segmental recesses 35 shown in FIGS. 8 and 9, or a plurality of cut-out portions 36 shown in FIG. 11.

In FIG. 6, the annular recess 34 is shown to extend from the outer annular face of the flange 28 and terminate substantially intermediate the thickness of the flange 28. On the contrary thereto, in FIG. 7, the annular recess 34' is shown to extend from the inner annular face of the flange 28, opposed to the outer annular face of the flange 28 where, in the example of FIG. 6, the annular recess 34 is formed, and terminate substantially intermediate the thickness of the flange 28.

In the example shown in FIGS. 8 and 9, the segmental recesses 35, arranged in a circular configuration in circumferentially equally spaced relation to each other, are shown to extend from the inner annular face of the flange 28 and terminate substantially intermediate the thickness of the flange 28. It is to be noted that these segmental recesses 35 may be formed on the outer annular face of the flange 28 in a manner substantially similar to the arrangement of FIG. 6.

In the example shown in FIG. 11, the cut-out portions 36 are formed along the outer peripheral edge of the flange and cut inward towards the intake pipe 27 at spaced intervals around the circumference of the flange 28, thereby leaving a corresponding number of radially outwardly extending segmental projections 37 in the intervals between the cut-out portions 36.

It is to be noted that the position and type of the connecting member are not limited by the position and type of the reduced surface contact area and vice versa. However, where the reduced surface contact area is employed in the form of the cut-out portions 36 such as shown in FIG. 11, the connecting member is preferably constituted by the metal segments 33 rigidly secured to or integrally formed with the flange 20 on the tubular insert 19 as shown in FIG. 10.

It is further to be noted that, where the connecting member is separate from and, therefore, must be secured or welded to either one of the flanges 20 and 28, the connecting member is preferably made of a metallic material having a relatively high thermal conductivity. However, as is the case with the one-piece construction of the connecting member with either one of the flanges 20 and 28, the connecting member may be made of the same material as such either one of the flanges 20 and 28.

From the foregoing description, it has now become clear that, even though a clearance exists between the respective flanged ends of the tubular insert within the exhaust passage and the intake pipe within the thermal reactor because of the interposition of the gasket 32, the temperature of the intake pipe 27 can readily and effectively be transmitted to the tubular insert 19, thereby substantially eliminating any possible temperature difference between the tubular insert and the intake pipe. It is also clear that, irrespective of the presence of the gasket 32, the interposition of the connecting member and the presence of the reduced surface contact area permit the tubular insert 19 and the intake pipe 27 to be relatively fixedly restrained in position.

Although the present invention has fully been described by way of the examples with reference to the accompanying drawings, it is to be noted that various changes and modifications will be apparent to those skilled in the art. Such changes and modifications, unless they depart from the true scope of the present invention, are to be construed as being included within the scope of the present invention.

I claim:

1. A system for connecting a thermal reactor to an internal combustion engine, said thermal reactor including outer and inner casings, said inner casing defining therein a reaction chamber and said outer casing surrounding the inner casing and having at least one mounting flange through which the thermal reactor is operatively coupled to the internal combustion engine, said outer casing further having a first flat, planar surface in which an intake port is defined in communication with the reaction chamber, said combustion engine including an engine casing having at least one combustion chamber defined therein, said engine casing further having a second flat, planar surface in which an exhaust port is defined in communication with the combustion chamber, said connecting system comprising, in combination:

an exhaust passage defining portion of the engine casing having an exhaust passage defined therein and having one end radially outwardly enlarged to provide a larger diameter portion and the other end in communication with the combustion chamber;

a tubular insert having on one end a radially outwardly extending flange and loosely inserted within the exhaust passage with said flange on said tubular insert situated within the large diameter portion, and the other end facing the combustion chamber, the opening at said one end of the tubular insert constituting said exhaust port;

an intake pipe having one end opening into the reaction chamber through the inner casing and the other end having a radially outwardly extending flange, said flange on said intake pipe having an outer peripheral portion engaged with the mounting flange;

a connecting member in position between one of the opposed annular faces of the flange on the tubular insert facing the intake pipe and the opposed annular face of the flange on the intake pipe facing the tubular insert and having a thickness greater than the distance between the engine casing and the face of the flange on said intake pipe which faces said engine casing when said thermal reactor is mounted on said engine casing;

said flange on the intake pipe having an area of reduced surface contact thereon, said flange on the intake pipe being bent in a direction towards the flange on the tubular insert when the mounting flange is secured to the engine casing by the outer peripheral portion of the flange on the intake pipe being pressed towards the second planar surface surrounding the exhaust port for generating a resilient force; and said connecting member, when said mounting flange is secured to the engine casing, receiving said resilient force and transmitting it to said tubular insert for fixing said tubular insert and said intake pipe in position in said exhaust passage and said intake port.

2. The system as claimed in claim 1, wherein said intake pipe has a plurality of slots extending completely through the thickness of the flange in a direction substantially parallel to the longitudinal axis of the intake pipe and arranged in a circular configuration.

3. The system as claimed in claim 2, further comprising a gasket means tightly positioned between the first and second planar surfaces, the outer peripheral portion of the flange on the intake pipe being pressed towards the second planar surface through said gasket means.

4. The system as claimed in claim 3, wherein said connecting member is a metal ring.

5. The system as claimed in claim 4, wherein said metal ring is integrally formed with the opposed annular face of one of the respective flanges on the intake pipe and the tubular insert.

6. The system as claimed in claim 4, wherein said metal ring is welded to the opposed annular face.

7. The system as claimed in claim 3, wherein said connecting member is a plurality of metal segments arranged in a circular configuration in spaced relation to each other.

8. The system as claimed in claim 7, wherein said metal segments are integrally formed with the opposed annular face of one of the respective flanges on the intake pipe and the tubular insert.

9. The system as claimed in claim 7, wherein said metal segments are welded to said opposed annular face of one of the respective flanges on the intake pipe and the tubular insert.

10. The system as claimed in claim 1, wherein one of the annular faces on the flange on said intake pipe has an annular recess therein extending therefrom and terminating substantially intermediate the thickness of the flange on said intake pipe.

11. The system as claimed in claim 10, further comprising a gasket means tightly positioned between the first and second planar surfaces, the outer peripheral portion of the flange on the intake pipe being pressed towards the second planar surface through said gasket means.

12. The system as claimed in claim 10, wherein said annular recess is on the annular face of the flange which is toward the engine.

13. The system as claimed in claim 12, further comprising a gasket means tightly positioned between the first and second planar surfaces, the outer peripheral portion of the flange on the intake pipe being pressed towards the second planar surface through said gasket means.

14. The system as claimed in claim 10, wherein said annular recess is on the annular face of the flange which is away from the engine.

15. The system as claimed in claim 14, further comprising a gasket means tightly positioned between the first and second planar surfaces, the outer peripheral portion of the flange on the intake pipe being pressed towards the second planar surface through said gasket means.

16. The system as claimed in claim 1, wherein said one of the annular faces of the flange on the intake pipe has a plurality of segmental recesses in a circular configuration and in spaced relation to each other.

17. The system as claimed in claim 16, further comprising a gasket means tightly positioned between the first and second planar surfaces, the outer peripheral portion of the flange on the intake pipe being pressed towards the second planar surface through said gasket means.

18. The system as claimed in claim 1, wherein said flange on the intake pipe has a plurality of cut-out portions along the outer peripheral edge of the flange extending inward towards the intake pipe at spaced intervals around the circumference of the flange with segmental projections defined in the intervals between the cut-out portions.

19. The system as claimed in claim 18, further comprising a gasket means tightly positioned between the first and second planar surfaces, the outer peripheral portion of the flange on the intake pipe being pressed towards the second planar surface through said gasket means.

20. The system as claimed in claim 1, further comprising a gasket means tightly positioned between the first and second planar surfaces, the outer peripheral portion of the flange on the intake pipe being pressed towards the second planar surface through said gasket means.

21. The system as claimed in claim 20, wherein said connecting member is a metal ring, said metal ring having a thickness greater than the thickness of the gasket means.

22. The system as claimed in claim 21, wherein said metal ring is integrally formed with the opposed annular face of one of the respective flanges on the intake pipe and the tubular insert.

23. The system as claimed in claim 21, wherein said metal ring is welded to the opposed annular face of one of the respective flanges on the intake pipe and the tubular insert.

24. The system as claimed in claim 21, wherein said connecting member is comprised of a plurality of metal segments arranged in a circular configuration in spaced relation to each other, each of said metal segments having a thickness greater than the thickness of the gasket means.

25. The system as claimed in claim 24, wherein said metal segments are integrally formed with the opposed annular face of one of the respective flanges on the intake pipe and the tubular insert.

26. The system as claimed in claim 24, wherein said metal segments are welded to said opposed annular face of one of the respective flanges on the intake pipe and the tubular insert.

27. The system as claimed in claim 1, wherein said connecting member is a metal ring.

28. The system as claimed in claim 27, wherein said metal ring is integrally formed with the opposed annular face of one of the respective flanges on the intake pipe and the tubular insert.

29. The system as claimed in claim 27, wherein said metal ring is welded to the opposed annular face of one of the respective flanges on the intake pipe and the tubular insert.

30. The system as claimed in claim 1, wherein said connecting member is comprised of a plurality of metal segments arranged in a circular configuration in spaced relation to each other.

31. The system as claimed in claim 30, wherein said metal segments are integrally formed with the opposed annular face of one of the respective flanges on the intake pipe and the tubular insert.

32. The system as claimed in claim 30, wherein said metal segments are welded to the opposed annular face of one of the respective flanges on the intake pipe and the tubular insert.

* * * * *